US008774366B2

(12) United States Patent
Walk

(10) Patent No.: US 8,774,366 B2
(45) Date of Patent: Jul. 8, 2014

(54) VOLTAGE STABILIZATION FOR GRID-CONTROLLED X-RAY TUBES

(75) Inventor: Johannes Walk, Buckenhof (DE)

(73) Assignee: Siemens Aktiengesellschaft, München (DE)

( * ) Notice: Subject to any disclaimer, the term of this patent is extended or adjusted under 35 U.S.C. 154(b) by 211 days.

(21) Appl. No.: 12/915,355

(22) Filed: Oct. 29, 2010

(65) Prior Publication Data

US 2011/0103552 A1 May 5, 2011

(30) Foreign Application Priority Data

Nov. 2, 2009 (DE) ..... 10 2009 051 633

(51) Int. Cl.
*H05G 1/32* (2006.01)

(52) U.S. Cl.
USPC ..... 378/112; 378/113

(58) Field of Classification Search
USPC ..... 378/111, 112, 113, 138
See application file for complete search history.

(56) References Cited

U.S. PATENT DOCUMENTS

| | | | | |
|---|---|---|---|---|
| 4,578,767 | A * | 3/1986 | Shapiro | 378/111 |
| 5,664,000 | A * | 9/1997 | Van Woezik et al. | 378/112 |
| 6,944,268 | B2 | 9/2005 | Shimono | |
| 7,016,468 | B1 * | 3/2006 | Krema et al. | 378/111 |
| 2004/0017893 | A1 * | 1/2004 | Beyerlein et al. | 378/111 |
| 2004/0114722 | A1 * | 6/2004 | Shimono | 378/138 |
| 2008/0043917 | A1 | 2/2008 | Oreper et al. | |

FOREIGN PATENT DOCUMENTS

| | | |
|---|---|---|
| DE | 3437064 A1 | 4/1986 |
| DE | 101 36 947 A1 | 2/2003 |
| DE | 102 28 336 C1 | 11/2003 |
| JP | 11-204289 | 7/1999 |

OTHER PUBLICATIONS

German Office Action dated Jun. 25, 2010 for corresponding German Patent Application No. DE 10 2009 051 633.6 with English translation.

* cited by examiner

*Primary Examiner* — Glen Kao
(74) *Attorney, Agent, or Firm* — Lempia Summerfield Katz LLC

(57) ABSTRACT

The present embodiments improve the radiation monochromy of an x-ray device with a control electrode for controlling a flow of electrons generated between a cathode and an anode. A correction voltage is generated in accordance with a correction function. This correction voltage is used for correction of a voltage applied between the anode and the cathode in terms of a constant voltage, even in the period of control using the control electrode. The voltage applied between the anode and the cathode is corrected with the generated correction voltage.

22 Claims, 8 Drawing Sheets

Synchronization of the correction function to the inverter control

VOLTAGE STABILIZATION FOR GRID-CONTROLLED X-RAY TUBES

This application claims the benefit of DE 10 2009 051 633.6, filed Nov. 2, 2009.

BACKGROUND

The present embodiments relate to an x-ray device with a control electrode for controlling a flow of electrons generated between a cathode and an anode.

X-rays are in widespread use in medical diagnosis. In such applications, the x rays may be generated by x-ray tubes. An x-ray tube may include a housing in which a vacuum is established. The x-ray tube also includes an anode and a cathode, which are found inside the vacuum housing. For operation, the cathode may be heated up in order to assist the emission of electrons. The x-rays are then generated by application of a voltage between the anode and the cathode. This may involve a high voltage in the range 40-125 kV, which is provided by a generator. The voltage applied allows electrons to exit from the cathode. The electrons are accelerated and, on striking the anode, generate x-rays that leave the housing through an exit window.

For better control of the irradiation, control electrodes (e.g., a control grid) may be used. Instead of setting up and removing the voltage between the anode and the cathode, the control electrode is arranged in the housing between the anode and the cathode in such a way as to allow the flow of electrons to the anode to be stopped by application of a control voltage between the electrode and the cathode. The application of the control voltage may be a blocking voltage, which may also be generated by the generator. This method is described, for example, in publications DE 101 36 947 A1 and JP 11204289 A.

During operation of powerful grid-blockable tubes with a high switching speed when high voltage is present and steep-edged switching of the radiation (equivalent to applying a load), a collapse or an overshoot in the high voltage is evident. The deviation of this actual tube voltage from the nominal value amounts quantitatively to up to around 40% and leads to a non-monochromatic radiation at the beginning or end of radiation. The deviation may also lead, in the case of an overvoltage peak, to an increased risk of flashovers and to damage caused by these flashovers and other damage. This has a reciprocal effect to the imaging time on the x-ray quality and is thus of significance with very short pulses in particular.

SUMMARY AND DESCRIPTION

The present embodiments may obviate one or more of the drawbacks or limitations in the related art. For example, in one embodiment, an x-ray device that produces a high monochromy of radiation even with short pulses.

Exemplary embodiments and advantages explained below in conjunction with the x-ray device apply equally to the method and vice versa.

In one embodiment, an x-ray device with a control electrode for controlling a flow of electrons generated between a cathode and an anode is provided. The x-ray device is configured for generating a correction voltage or a corrected voltage. The correction voltage is generated in the x-ray device in accordance with a correction function for correcting a voltage (e.g., high voltage) applied between the anode and the cathode. The correction function is designed for a correction in terms of or for obtaining a constant voltage (to the greatest possible extent). The form of the correction function is also specified with respect to a constant voltage within the control period using the control electrode and where possible, a compensation for signal delay times arising. The x-ray device (e.g., a generator) is configured for correcting the voltage applied between the anode and the cathode in accordance with the correction voltage in order to improve the voltage stability of the voltage applied between the anode and the cathode.

The correction voltage may be the voltage present between the anode and the cathode (e.g., a voltage between anode and cathode corrected with respect to improved stability). However, the voltage may also involve an additional voltage (e.g. voltage pulse) that is applied between the anode and the cathode in order to influence or to correct the voltage already present in terms of a more stable overall voltage.

The present embodiments lead to an improved voltage constancy between the anode and the cathode (e.g., at the beginning and end of radiation). This avoids deviations of the radiation energy or strength of the x-rays generated from the set value occurring on switching on and switching off (e.g., improved kV stability at radiation start and end). An improved monchromy of the radiation or a more constant radiation strength is thus achieved.

A further advantage is the avoidance of voltage peaks or the prevention of the occurrence of overvoltages or peak voltages, which may lead to strain on the electronics and the emitter (tube). Strain on the electronics and the emitter may lead to errors and outages.

In one embodiment the x-ray device includes a voltage regulator for regulating the voltage between the anode and the cathode. The x-ray device is configured for explicit influencing of the regulator using at least one signal generated in accordance with the correction function. In such cases, a signal generated by the regulator for improving the voltage constancy may be influenced or corrected.

In one embodiment, the x-ray device or the generator is configured for measurement of the effective voltage of the voltage existing between the anode and the cathode. "Effective voltage" may be the voltage corrected by the correction voltage. The device or the generator is additionally configured to enable the correction function to be adapted in accordance with a deviation of the effective voltage from a nominal value. A manual or automatic adaptation may be provided. The nominal value may be the voltage value used for irradiation with a set radiation energy of the x-rays.

The correction function may be adapted with respect to the parameters time and form. The time parameter may be related to a beginning or an end of an irradiation. For example, the correction function may be modifiable or shiftable on the time scale in accordance with a deviation of the effective voltage from a nominal value, in order to obtain the best possible compensation for voltage fluctuations. Another possible parameter for optimizing the correction function is the duration of the correction function. The correction function may be specified in analog or digital form and may be described by an analytical function. An interpolation of function values may be provided. This interpolation may be both an interpolation with respect to the time and also with respect to different operating points. The functional values may represent voltage or current values, for example, in accordance with which a voltage correction process is created. This may occur, for example, within the course of an adaptation or modification of a regulating signal. The x-ray device may thus comprise a regulation circuit for stabilizing the voltage applied between the anode and the cathode. There may be provision, in accordance with the correction function, for adapting a signal generated for regulation so that the stabilization imparted by the regulation may be improved.

In one embodiment, the generator is configured for beginning a correction before the onset of an irradiation that is associated with the voltage deviations to be corrected by the voltage correction process. The time shift between the beginning of the voltage correction process or a signal generated for the process and the beginning of the irradiation may be adjusted. The same applies for the end of the irradiation.

In one embodiment, the x-ray device or the system includes a table (Look-up table) with parameters that encode the correction function (or values of the correction function). The parameters may be read out for generating a signal for voltage correction or may be loaded. Parameters are provided for different operating points. To adapt the voltage correction process, parameters of the table may be overwritten or be replaced with adapted parameters.

In one embodiment, the x-ray device includes hardware elements for generating high voltages. The hardware elements include an inverter, and the control of the inverter may be correlated or synchronized to the time sequence of the voltage correction or of a signal generated in this purpose.

In another embodiment, a method for operating an x-ray device with a control electrode for controlling a flow of electrons generated between a cathode and an anode is provided. The method includes generating a voltage correction in accordance with a correction function for correcting a voltage applied between the anode and the cathode in terms of a constant voltage, even in the period of control using the control electrode.

DETAILED DESCRIPTION OF THE DRAWINGS

Figure 1:
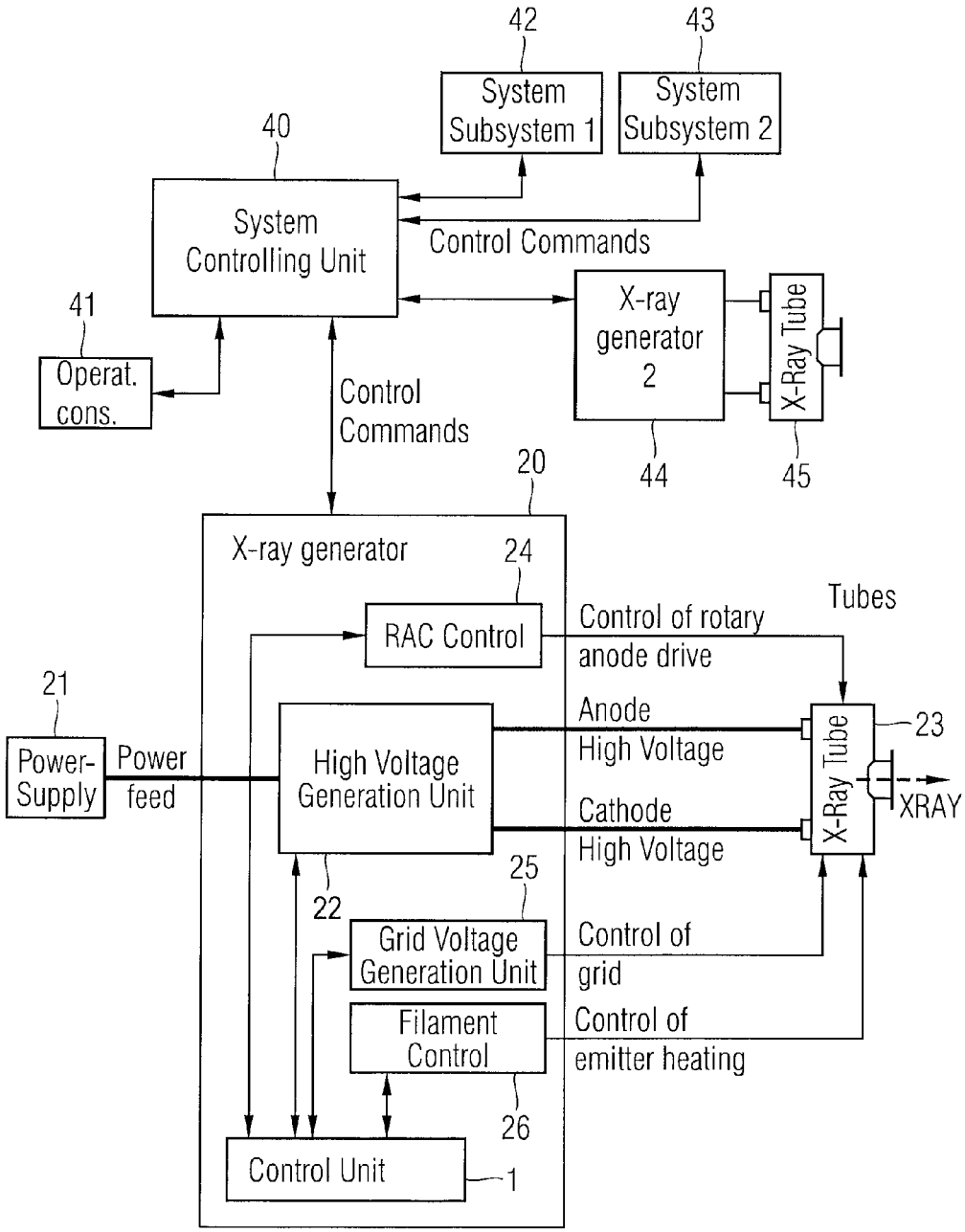
FIG. 1 shows an x-ray system.

FIG. 1 shows an overview of components of an x-ray system. An x-ray generator 20 includes a control unit 1 and elements including an inverter/high-voltage generator 22 (e.g., a high voltage generation unit 22), a Rotation Anode Control 24, a grid voltage generation unit 25 and a control unit 26 for heating a cathode or an emitter of an x-ray tube 23. An energy supply 21 is also shown in the diagram. The voltages (e.g., anode voltage, cathode voltage and grid voltage) and other signals (e.g., control of Rotation Anode Control, control of emitter heating) for the x-ray tube 23 are provided using the elements. X-rays XRAY are generated using the x-ray tube 23. The x-ray system also includes a central system control unit 40 with an operating console 41. There is provision, using the control unit 40, for control of further systems 42 and 43 and a second x-ray generator 44 that drives a further x-ray tube 45.

Figure 2:
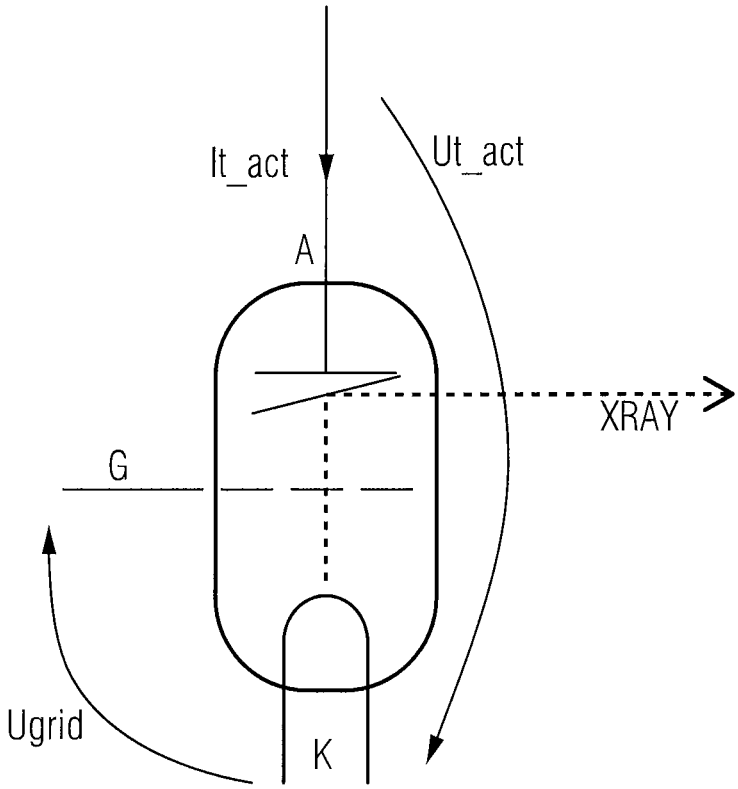
FIG. 2 shows a schematic diagram of an x-ray tube.

FIG. 2 shows a schematic diagram of an x-ray tube and illustrates definitions of variables relevant for the tube. A cathode K and an anode A are arranged in a vacuum housing V. During operation, the cathode K emits electrons that are accelerated and strike the anode A. In this collision of the electrons, x-rays XRAY that may escape from the vacuum housing V through a window are created. When the x-ray tube is in operation, a current It_act flows. A voltage Ut_act is present between anode and cathode. The electrons are accelerated using the voltage Ut_act. The beginning and end of the irradiation is controlled using a control grid G or via the high-voltage UT_act. Between the control grid G and the cathode K, a voltage Ugrid is present. A blocking of the flow of electrons from the cathode K to the anode A may be effected or established with the voltage Ugrid. In this case, the voltage Ut_act between the anode and the cathode should remain as constant as possible regardless of whether irradiation is being performed or not.

In one embodiment, the x-ray generator is operated for an irradiation with approximately 40-125 kV and 0-1000 mA (50-100 kW). The grid voltage may be 4 kV, for example. The rise and fall times of the grid voltage may be <1.00 μs, for example.

Figure 3:
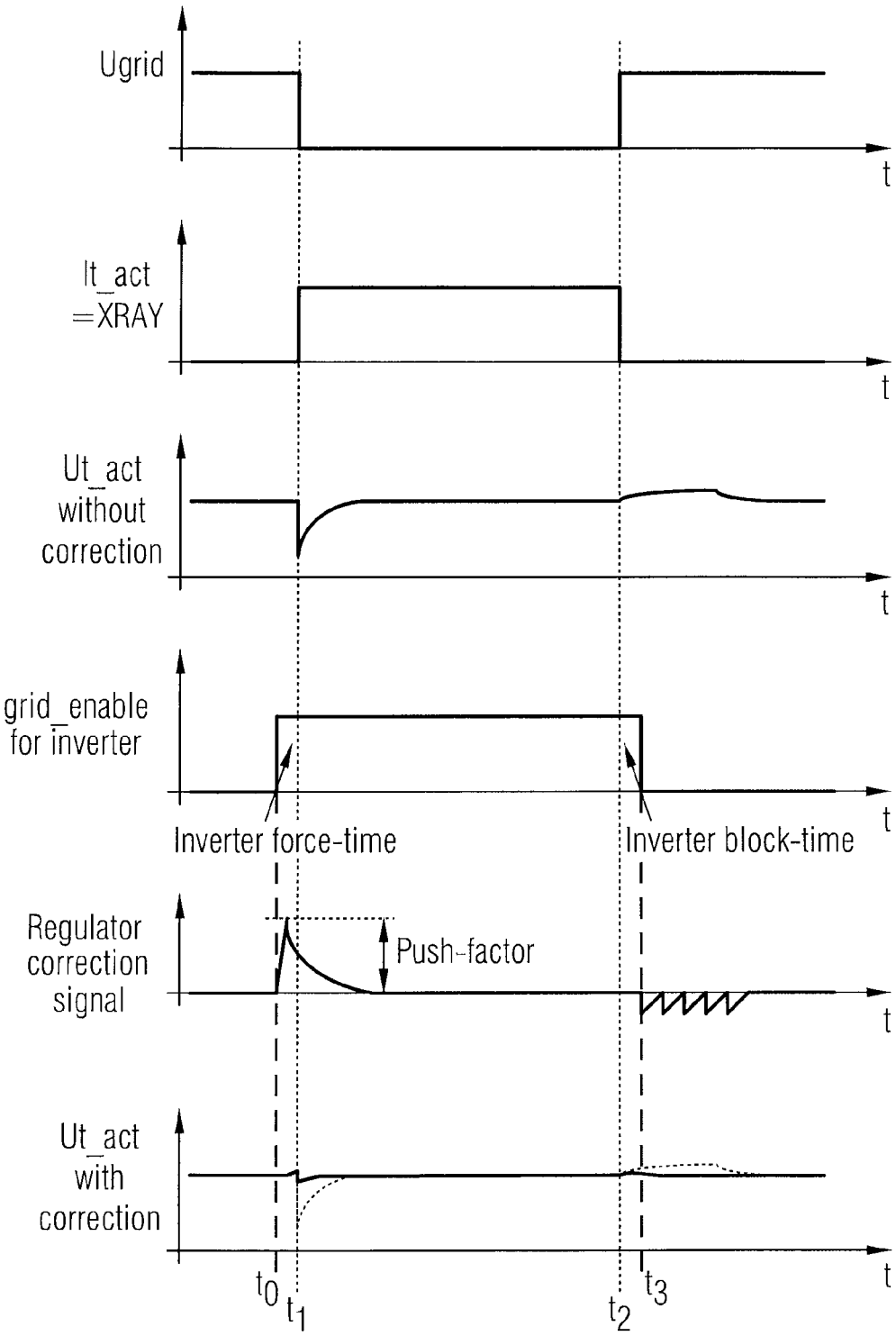
FIG. 3 shows different signal curves.

FIG. 3 shows signal curves for the variables and control signals depicted in FIG. 2. The topmost curve shows the progress of the grid voltage Ugrid. Initially, a grid voltage that prevents a flow of electrons is present. X-ray radiation is generated by enabling the grid. At time t1 in FIG. 3, the grid voltage is switched off. The electrons emitted by the cathode are accelerated after the blocking voltage drops away towards the anode and, and the electrons generate x-ray radiation as the electrons decelerate. At time t2, the grid voltage is switched on again in order to end the radiation process. The radiation period is the time difference t2–t1, which may be seen in the second signal curve from the top. The second signal curve from the top shows the resulting current It_act that leads to x-ray radiation XRAY. The resulting current It_act is not equal to zero in the period of the irradiation between t1 and t2 (i.e., x-ray radiation XRAY is being generated during this period). The third curve from the top shows the uncorrected high-voltage Ut_act present between the anode and the cathode. The uncorrected high-voltage Ut_act may be present between and during irradiation pulses. The third curve shows that after the switch-on time t1 and also after the switch-off time t2, disturbances occur in the voltage Ut_act, which lead to a deviation from the desired voltage constancy (e.g., a load change). The voltage drop shown in the third curve leads to a lower acceleration of the electrons and consequently, to the energy of the x-rays generated deviating from the value set. The radiation is thus, at least at the start, not as monochrome as desired.

This difficulty is also not rectified by the high voltage regulators that may be used. High voltage regulators of this type may need up to around 500 μs in order to regulate the deviation from the nominal value that is occurring out to an acceptable value. In the present embodiments, a feedforward control opposing this load change is introduced in the form of a correction function that may be shifted over time. This may correct both dead times of the high-voltage power electronics (e.g., 16-30 μs) and also of any given design of regulator. The function may, for example, be calculated by a logic module and be triggered at a specific time before a switching event. This may occur in the form of an effect on a high voltage regulator used (analog or digital), for which examples are described in FIG. 5.

The effect of the function of the present embodiments is illustrated in curves 4-6 from the top of FIG. 3. The fourth signal curve shows a control signal "grid_enable_for_inverter." The grid_enable_for_inverter control signal is the signal of the grid control length and is identified in front and behind by Tforce (inverter force-time) and Tblock (inverter block-time), respectively. The grid_enable_for_inverter control signal is switched on at time t0<t1 and switched off at time t3>t2. The reason for the length of the grid_enable_for_inverter control signal differing from the irradiation is because the correction function triggers at Tforce and Tblock.

The fifth curve shows a correction signal that includes two parts, one at the beginning of the irradiation and one at the end of the irradiation. The first part of the correction signal includes a steeply rising ramp that reaches a maximum value referred to as the push factor. This signal then falls somewhat more slowly down to zero. In this case, the signal is already started before the beginning of the actual irradiation (e.g., at time t0). The second part of the signal consists of a series of small pulses after the end of the irradiation. Shown in the sixth curve is the corrected voltage Ut_act between anode and cathode, which has a significantly higher constancy than the voltage curve without correction (indicated by thin lines).

Figure 4:
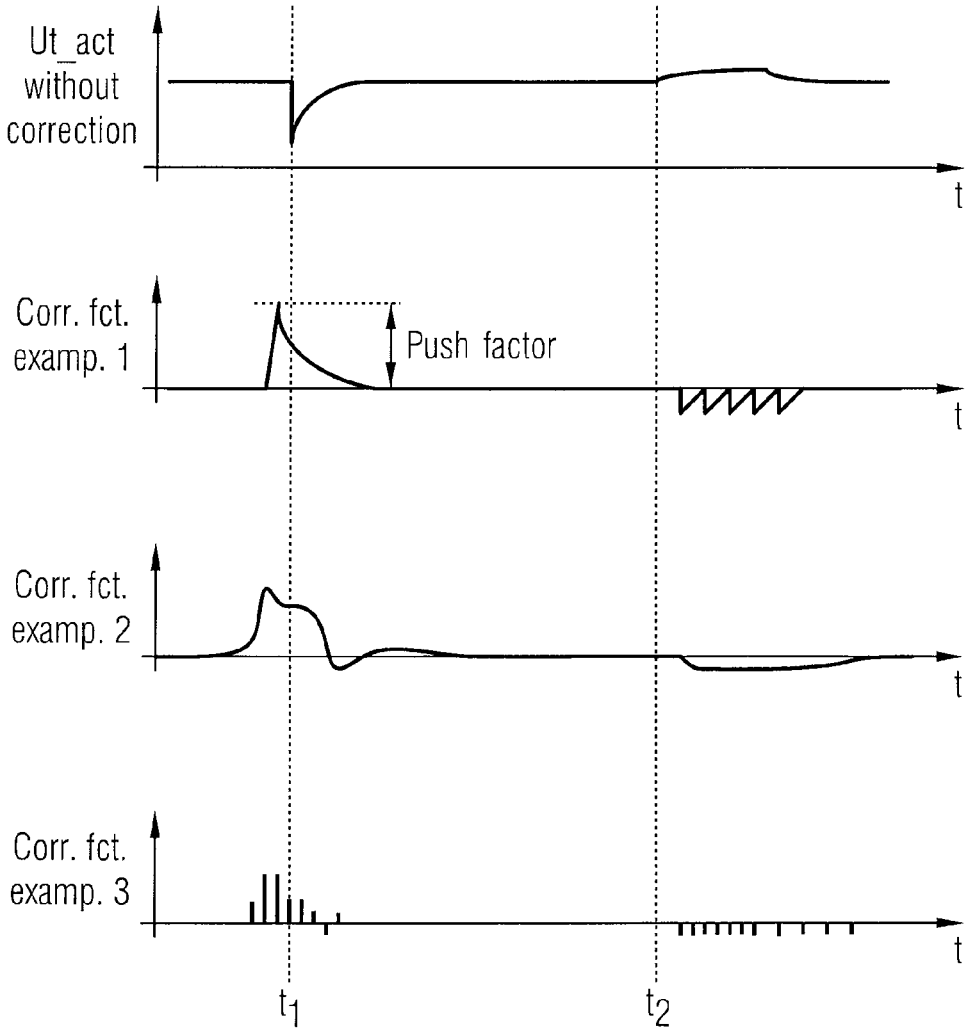
FIG. 4 shows correction signal curves.

FIG. 4 shows the various options of the correction function. The topmost curve corresponds to the voltage curve of Ut_act without correction (e.g., the third curve from the top in FIG. 2). Three different possible correction functions are shown in curves 2-4 from the top in FIG. 4. The correction function of curve 4 is digitized (i.e., defined by values at discrete points). A correction function may thus, as shown in FIG. 4, have different complex curves/shapes in analog and digital.

Figure 5:
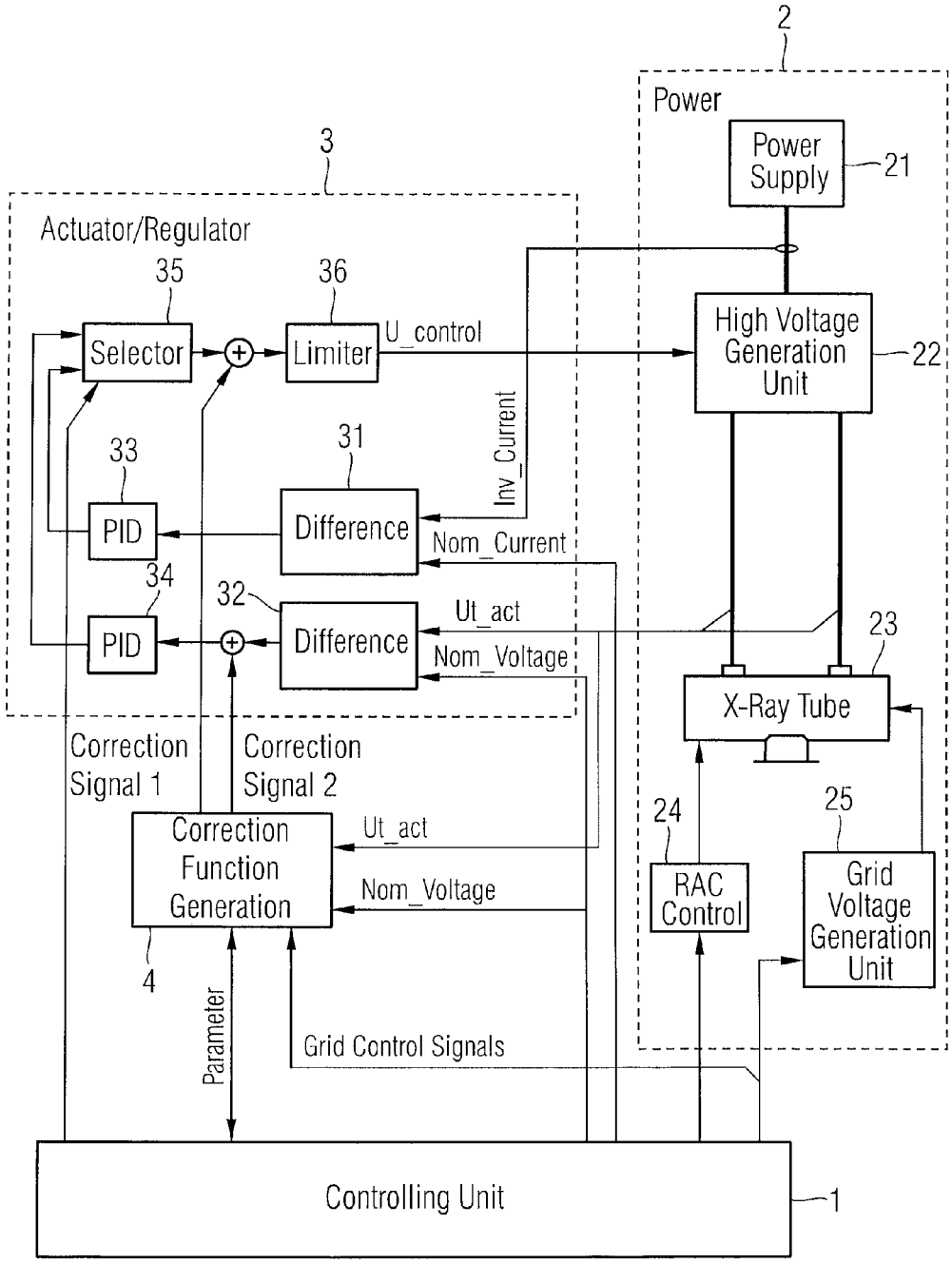
FIG. 5 shows a block diagram of feeding correction signal curves into a high-voltage regulator of an x-ray generator.

FIG. 5 shows a block diagram with the feeding of one embodiment of a correction function into a high-voltage regulator for an x-ray tube. A Controlling Unit 1 is shown in FIG. 1. This Controlling Unit 1 controls the irradiation sequence. The figure also shows an area 2 including the energy supply 21 and the x-ray tube 23. A further area 3 is used to regulate the voltage. Also shown is a unit 4 that generates a correction function or a correction signal of the present embodiments, respectively. Shown in the area 2 are the elements, including the energy supply 21, the inverter/high-voltage generator 22, the x-ray tube 23, the Rotation Anode Control 24 and the grid voltage generation unit 25. The emitter heating is to be part of the unit 22 in the example shown in FIG. 5 and is thus not shown explicitly.

The high-voltage generation unit 22 is fed by the energy supply 21. The high-voltage generation unit 22 generates the high-voltage that is used for the operation of the x-ray tube 23. The Rotation Anode Control 24 generates the alternating current used for the rotation of the rotary anode of the tube 23, and the grid voltage generation unit 25 is used to control the rotation of the rotary anode of the tube 23, with control signals being transferred to the Rotation Anode Control 24 and the grid voltage generation unit 25 by the control unit 1. The regulation area 3 includes two comparators or elements for forming the differences 31 and 32, two PID controllers 33 and 34 (e.g., regulators 33 and 34), a selection unit 35 and a limiter unit 36. A nominal value and an actual value for the current in the area of the energy supply or of the inverter oscillating current are compared using the comparator 31. The comparator 32 compares the nominal value and the actual value for the voltage present between the anode and the cathode of the x-ray tube 23. The difference is passed on, in each case, to the regulator 33 or 34, respectively. The selection unit 35 evaluates the difference and defines which deviation should be used for the regulation. The difference of the current value may be used as a criterion when the system is starting up while the voltage may be used as a regulating value once the system has been started up. The limiter unit 36 limits the inverter adjustment value (power section adjustment value) to a range between a minimum and a maximum value.

The correction provided by the regulator 3 of the manipulated variable is improved in accordance with the present embodiments by the introduction of a correction function. For this purpose, a correction function generation unit 4 is provided. The correction function generation unit 4 feeds a correction signal into the regulation circuit. Two points where the correction signal may be fed in are shown in FIG. 5 by way of example. In the first case, the signal delivered by the selection element 35 is corrected by the correction signal. In the second case, the signal generated by the comparator 32 is corrected by the feeding in of the correction signal (e.g., in terms of improved results for the difference between actual value and nominal value). The correction function generation unit 4 receives parameters from the control unit 1. In addition, the control signals for the grid voltage generation unit 25 are also transmitted to the correction function generation unit 4 by the control unit 1. The parameters and the control signals for the grid voltage generation unit 25 are both used to control this correction (e.g., with respect to the timing of use of the correction). The transmission of control signals for the grid voltage generation unit 25 to the correction function generation unit 4 allows for synchronization or correlation in time of the generation of the correction function and the switching on or switching off of the grid voltage.

The correction function generation unit 4 is also supplied with the current and nominal voltage values Ut_act and Nom_Voltage, respectively. The current and nominal voltage values may be used for learning, for example, in order to optimize the form of the correction function.

The high-voltage generation usually functions such that alternating voltage delivered by the energy supply 21 is first rectified. This rectified alternating voltage is transformed by a rectifier back into an alternating voltage, which is transformed by a transformer into high voltage. This transformed high voltage is again rectified and applied as direct current voltage to the x-ray tube 23. The generation of a correction function may be synchronized or correlated with the rectifier control. This is shown in greater detail in FIG. 6.

Figure 6:
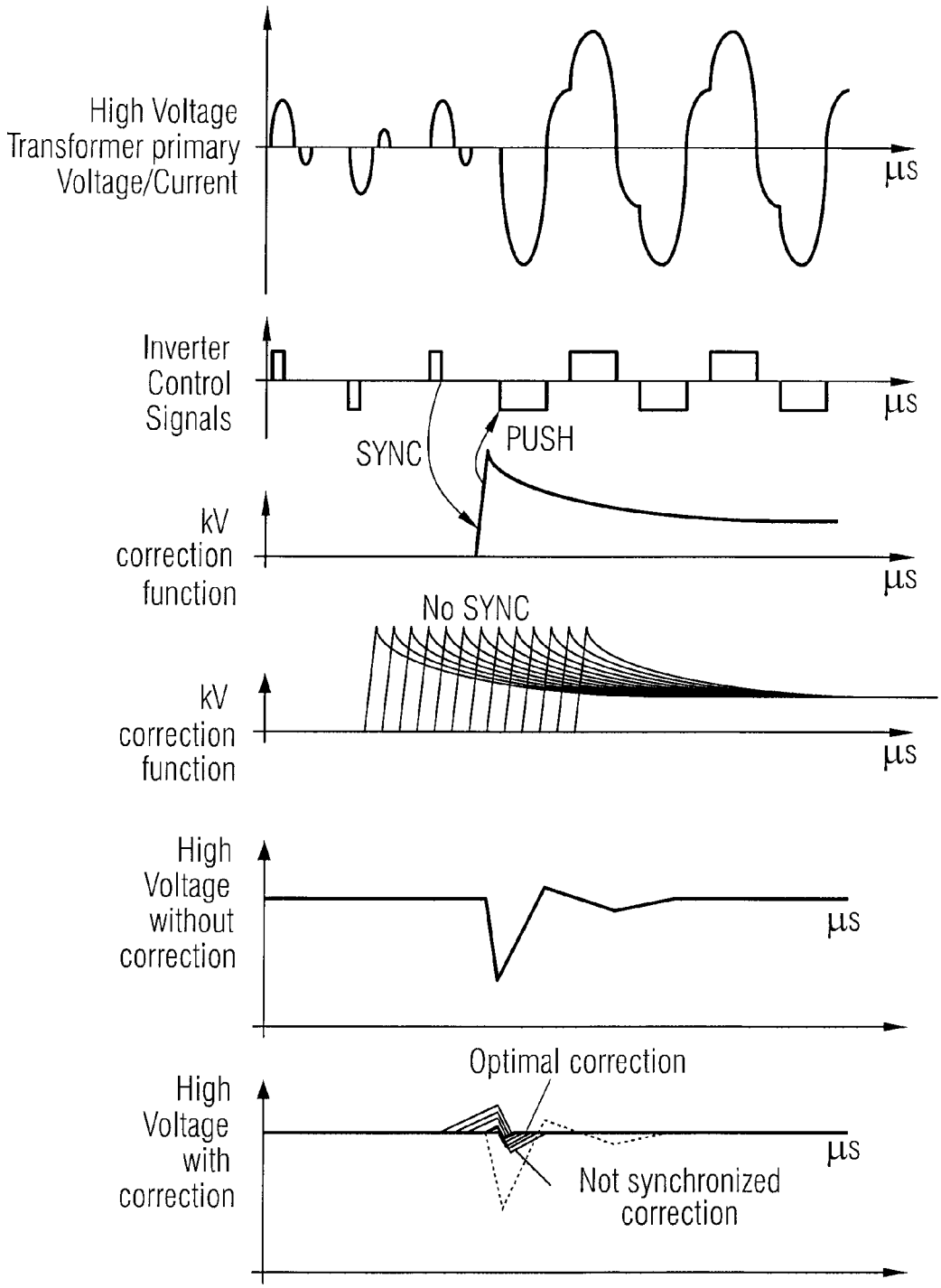
FIG. 6 shows the effect of a synchronization of correction signal curves to an inverter control in the x-ray generator.

The first curve from the top of FIG. 6 shows a current curve as generated by the rectifier on the primary side of the transformer. This curve correlates with the control signal shown in the second curve from the top for controlling the rectifier. With the fourth control signal of the second curve, the frequency of the rectifier is changed, which corresponds, within the context of a change to the grid voltage, to starting the irradiation. A correction function is shown in the third curve from the top. The beginning of the correction function shown in the third curve is synchronized with the control signals shown in curve two. The synchronization is done in such a way that the correction signal begins a specific time for the fourth control signal in curve two initiating the irradiation. The fourth curve from the top shows a plurality of possible starting points of the correction curve if no synchronization takes place. The fourth curve shows the voltage between the anode and the cathode without correction and the bottom curve of FIG. 6 shows the effect of the correction. The bold solid line of the lowest curve is the line that is obtained with the synchronized correction function. Also indicated are a series of curve shapes that would be obtained with non-synchronized function curves as well as the curve without correction (as a dotted line). FIG. 6 shows that the synchronized correction function delivers the best result.

The correction function of the present embodiments may be adapted for the respective x-ray device. The different conditions at different operating points may be taken account of (e.g., depending on the operating point (as a rule produced by voltage and/or current values set)) to use correspondingly adapted or optimized correction functions. Determining the parameters for the correction function dependent on the operating point may be undertaken both empirically and manually, and also automatically in the form of a "learning routine" (FIG. 7) or in normal operation (FIG. 8). A fast high-voltage measurement circuit and a corresponding digital processing chain should be used for this purpose. The learnt values are, for example, stored in a multi-dimensional table (LUT: Look-up Table) in a memory and may be selected for further imaging and activated in accordance with the stored parameters.

Figure 7:
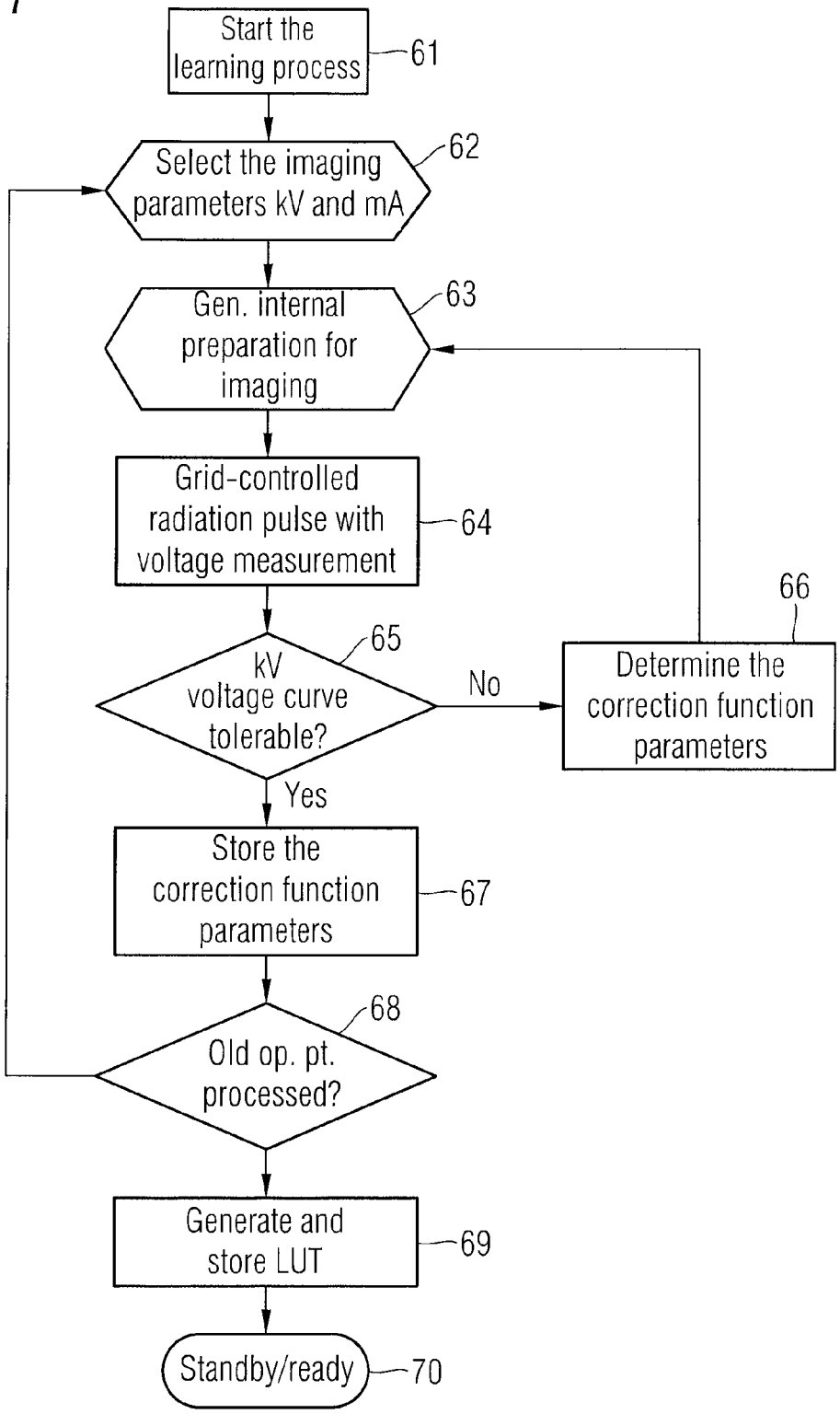
FIG. 7 shows a flow diagram for initial learning of a correction function.
Figure 8:
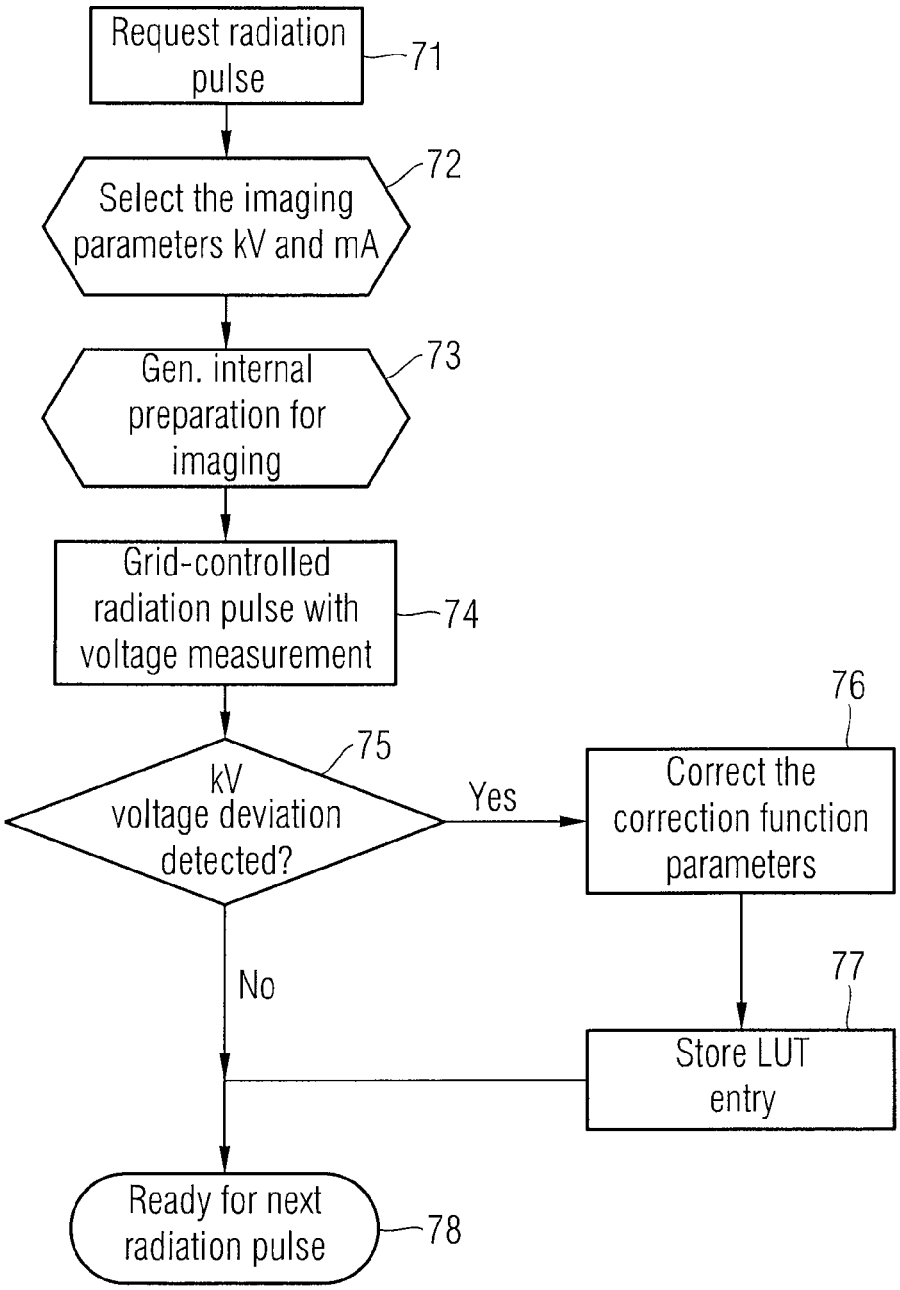
FIG. 8 shows a flow diagram for dynamic adjustment of voltage correction.

FIG. 7 shows a learning behavior or a learning process for a correction function dependent on the operating point. Only a few key points of the operating point area are tested for this purpose. The remaining correction values may be interpolated using a mathematical relationship (e.g., an interpolation function such as a spline may be placed through the determined values).

As shown in FIG. 7, the learning process is started in act 61. In act 62, imaging parameters are selected for voltage and current (e.g., in the units Kv and mA). Act 63 involves a generator-internal preparation of the entry. In act 64, a grid-controlled radiation pulse is generated, with the voltage being measured at the same time. The measured voltage is investigated in the next act 65 as to whether the deviation of the voltage curve from the nominal curve remains within a tolerance. If the deviation is too large, correction function parameters are determined in act 66, using which the correction function is corrected for the next image. If in act 65, the voltage curve remains within the tolerance, the correction function parameters are stored in act 67. If all operating points have been processed (interrogation 68), a table (LUT: Look-up table) that contains the correction function is generated and stored. The device is ready for use with the correction of the present embodiments.

FIG. 8 shows an adaptation of the function undertaken by learning in normal mode or impulse mode. A type of "retrospective learning" of the correction function table takes place. The high voltage is checked for overshoots and undershoots during grid-controlled radiation beginning and end. Should a deviation be present, the function parameters may be easily adapted.

In the first step in the method according to FIG. 8, a radiation pulse is requested from the higher-ranking entity (act 71). Imaging parameters are defined for this (act 72). In act 73, the recording is prepared, and in act 74, a radiation pulse is generated by grid control, with the voltage being measured at the same time. In a decision 75, the deviation from nominal values is assessed. If the deviation is too large, the parameters of the function are corrected 76 and stored in the table LUT 77. Afterwards or if the voltage deviation lies within the tolerance range, the device is ready for the next radiation pulse (act 78).

Many other embodiments of the correction of the voltage of an x-ray tube present between the anode and the cathode of the present embodiments may be obtained directly from the information contained in the description by the person skilled in the art. For example, different options for feeding in a correction may be provided. The solutions shown in the exemplary embodiment are only examples and are not intended to restrict the subject matter.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An x-ray device with a cathode and an anode to thereby generate x-rays, the x-ray device comprising:

a correction function generation unit configured to generate a correction signal based on a correction function;

a voltage generator coupled to the correction function generation unit and configured to generate a correction voltage, based on the correction signal, to correct a voltage applied between the anode and the cathode in terms of voltage constancy; and a control electrode between the cathode and the anode for controlling a flow of electrons generated between the cathode and the anode, the control electrode being configured to correct the voltage applied between the anode and the cathode, based on the correction voltage, during a period of control;

wherein the correction function generation unit is further configured to generate the correction signal at a variable start time, and wherein the variable start time comprises a time that is earlier than a start time of the voltage to be corrected.

2. The x-ray device as claimed in claim 1, further comprising:

a voltage regulator for regulating the voltage between the anode and the cathode, the voltage regulator being influenced by the correction signal.

3. The x-ray device as claimed in claim 2, wherein the correction function generation unit is configured to measure an effective voltage between the anode and the cathode, and wherein the correction function generation unit is configured to adapt the correction function in accordance with a deviation of the effective voltage from a nominal value.

4. The x-ray device as claimed in claim 3, wherein the correction function generation unit is configured to adapt the correction function with respect to time and form.

5. The x-ray device as claimed in claim 2, wherein the correction function generation unit is configured to adapt the correction function with respect to time and form.

6. The x-ray device as claimed in claim 2, wherein the correction signal generated by the correction function generation unit begins before the onset of an irradiation, the correction signal being connected to voltage deviations to be corrected by the correction function, and wherein the time shift between beginning of the correction signal and beginning of the irradiation is operable to be adapted.

7. The x-ray device as claimed in claim 2, further comprising device elements for high-voltage generation, wherein the device elements include an inverter or a switching regulator, and wherein the control of the inverter is correlated with the time sequence of the generation of the correction voltage.

8. The x-ray device as claimed in claim 1, wherein the correction function generation unit is configured to measure an effective voltage between the anode and the cathode, and wherein the correction function generation unit is configured to adapt the correction function in accordance with a deviation of the effective voltage from a nominal value.

9. The x-ray device as claimed in claim 8, wherein the correction function generation unit is configured for manual or automatic adaptation.

10. The x-ray device as claimed in claim 9, wherein the correction function generation unit is configured to adapt the correction function with respect to time and form.

11. The x-ray device as claimed in claim 9, wherein the correction signal generated by the correction function generation unit begins before the onset of an irradiation, the correction signal being connected to voltage deviations to be corrected by the correction function, and wherein the time shift between beginning of the correction signal and beginning of the irradiation is operable to be adapted.

12. The x-ray device as claimed in claim 8, wherein the correction function generation unit is configured to adapt the correction function with respect to time and form.

13. The x-ray device as claimed in claim 12, wherein the correction function generation unit is configured to change the correction function on the time scale in accordance with a deviation of the effective voltage from a nominal value.

14. The x-ray device as claimed in claim 8, further comprising device elements for high-voltage generation, wherein the device elements include an inverter or a switching regulator, and wherein the control of the inverter is correlated with the time sequence of the generation of the correction voltage.

15. The x-ray device as claimed in claim 1, wherein the correction signal generated by the correction function generation unit begins before the onset of an irradiation, the correction signal being connected to voltage deviations to be corrected by the correction function, and wherein the time shift between beginning of the correction signal and beginning of the irradiation is operable to be adapted.

16. The x-ray device as claimed in claim 1, further comprising:

a memory storing a table with parameters that encode the correction function, wherein the correction function generation unit is configured to read out the parameters to generate the correction signal.

17. The x-ray device as claimed in claim 1, further comprising device elements for high-voltage generation, wherein the device elements include an inverter or a switching regulator, and wherein the control of the inverter is correlated with the time sequence of the generation of the correction voltage.

18. A method for operating an x-ray device with a cathode, an anode to thereby generate x-rays, and a control electrode between the cathode and the anode for controlling a flow of electrons generated between the cathode and the anode, the method comprising:

generating a correction signal at a variable start time based on a correction function;

generating a correction voltage in accordance with the correction signal for the correction of a voltage applied between the anode and the cathode in terms of voltage constancy; and correcting the voltage applied between the anode and the cathode in accordance with the correction voltage;

wherein the voltage applied between the anode and the cathode is corrected in a period of control using the control electrode; and wherein the variable start time comprises a time that is earlier than a start time of the voltage to be corrected.

19. The method as claimed in claim 18, further comprising:

measuring an effective voltage between the anode and the cathode; and adapting the correction function in accordance with a deviation of the effective voltage from a nominal value.

20. The method as claimed in claim 19, wherein adapting the correction function comprises adapting the correction function with respect to time and form.

21. An x-ray device with a cathode and an anode to thereby generate x-rays, the x-ray device comprising:

a voltage regulator for regulating the voltage between the anode and the cathode;

a correction function generation unit configured to generate a correction signal based on a correction function, the correction function generation unit further configured to influence the voltage regulator using the correction signal;

a voltage generator configured to generate a correction voltage, based on the correction function, to correct a voltage applied between the anode and the cathode in terms of voltage constancy; and a control electrode between the cathode and the anode for controlling a flow of electrons generated between the cathode and the anode, the control electrode being configured to correct the voltage applied between the anode and the cathode, based on the correction voltage, during a control period, wherein the correction function generation unit is further configured to:

measure an effective voltage between the anode and the cathode;

adapt the correction function based on a deviation of the effective voltage from a nominal value, the adaption of the correction function being with respect to time and form; and generate the correction signal at a variable start time, wherein the variable start time comprises a time that is earlier than a start time of the voltage to be corrected.

22. The x-ray device as claimed in claim 21, wherein the correction function generation unit is further configured to change the correction function on a time scale based on a deviation of the effective voltage from a nominal voltage.

* * * * *